US009097143B2

(12) United States Patent
Smith et al.

(10) Patent No.: US 9,097,143 B2
(45) Date of Patent: Aug. 4, 2015

(54) GENERATING POWER FROM MEDIUM TEMPERATURE HEAT SOURCES

(75) Inventors: Ian Kenneth Smith, London (GB); Nikola Rudi Stosic, London (GB)

(73) Assignee: CITY UNIVERSITY, London (GB)

( * ) Notice: Subject to any disclaimer, the term of this patent is extended or adjusted under 35 U.S.C. 154(b) by 558 days.

(21) Appl. No.: 12/735,688

(22) PCT Filed: Feb. 6, 2009

(86) PCT No.: PCT/GB2009/000334

§ 371 (c)(1),
(2), (4) Date: Nov. 8, 2010

(87) PCT Pub. No.: WO2009/098471

PCT Pub. Date: Aug. 13, 2009

(65) Prior Publication Data

US 2011/0048009 A1 Mar. 3, 2011

(30) Foreign Application Priority Data

Feb. 7, 2008 (GB) ..... 0802315.2

(51) Int. Cl.
*F01K 7/36* (2006.01)
*F01K 7/02* (2006.01)
*F01K 23/04* (2006.01)

(52) U.S. Cl.
CPC ... *F01K 7/36* (2013.01); *F01K 7/02* (2013.01); *F01K 23/04* (2013.01)

(58) Field of Classification Search
USPC ..... 60/116, 402, 115, 616, 618, 620, 60/643–681, 641.1–641.15; 62/651, 676, 62/671; 290/40 R; 180/65.25, 65.285
See application file for complete search history.

(56) References Cited

U.S. PATENT DOCUMENTS 3,751,673 A 8/1973 Sprankle
4,228,657 A 10/1980 Leo (Continued)

FOREIGN PATENT DOCUMENTS

DE 103 39 880 B3 3/2005
DE 10 2006 036 122 A1 2/2007

(Continued)

OTHER PUBLICATIONS

RU 2050441 C1 English Translation.*

(Continued)

*Primary Examiner* — Christopher Jetton
*Assistant Examiner* — Shafiq Mian
(74) *Attorney, Agent, or Firm* — Flynn, Thiel, Boutell & Tanis, P.C.

(57) ABSTRACT

A method, and associated apparatus, for generating power from medium temperature heat sources in the range of 200° to 700° C. with improved efficiency compared to systems operating on a Rankine cycle in which the working fluid is condensed at the same temperature. Water is heated in a boiler (11) with heat from the heat source A, (22) which may be a stream of exhaust gases (22), in order to generate wet steam having a dryness fraction in the range of 0.10 to 0.90 (10% to 90% dry). The wet steam is expanded to generate power in a positive displacement steam expander (21) such as a twin screw expander. The expanded steam is condensed at a temperature in the range of 70° C. to 120° C., and the condensed steam is returned to the boiler. The expanded steam may be condensed in the boiler of an Organic Rankine Cycle (22) to provide additional power, or by heat exchange with a heater of a heating system to provide a Combined Heat and cycle, thereby further improving the cycle efficiency.

10 Claims, 7 Drawing Sheets

(56) References Cited

U.S. PATENT DOCUMENTS

| | | | | | |
|---|---|---|---|---|---|
| 4,393,657 | A * | 7/1983 | Takatama | 60/653 |
| 4,557,112 | A * | 12/1985 | Smith | 60/651 |
| 4,712,380 | A * | 12/1987 | Smith | 60/641.2 |
| 4,759,314 | A * | 7/1988 | Banweg et al. | 122/406.4 |
| 5,000,003 | A * | 3/1991 | Wicks | 60/618 |
| 5,121,607 | A * | 6/1992 | George, Jr. | 60/712 |
| 6,003,317 | A * | 12/1999 | Neubert | 60/653 |
| 6,035,643 | A * | 3/2000 | Rosenblatt | 60/651 |
| 6,269,645 | B1 * | 8/2001 | Yamaguchi | 60/653 |
| 6,296,461 | B1 | 10/2001 | Stosic | |
| 6,845,618 | B2 * | 1/2005 | Niikura et al. | 60/618 |
| 7,421,854 | B2 * | 9/2008 | Shaffer et al. | 62/500 |
| 2004/0035111 | A1 * | 2/2004 | Ven et al. | 60/641.8 |
| 2009/0077971 | A1 * | 3/2009 | Schu | 60/670 |
| 2009/0188253 | A1 | 7/2009 | Smith et al. | |

FOREIGN PATENT DOCUMENTS

| | | | | |
|---|---|---|---|---|
| DE | 10 2006 003 815 | A1 | 8/2007 | |
| EP | 0 485 596 | A1 | 5/1992 | |
| EP | 0 898 655 | B1 | 2/2002 | |
| GB | 1 561 294 | A | 2/1980 | |
| GB | 2 114 671 | A | 8/1983 | |
| GB | 2 153 442 | A | 8/1985 | |
| JP | 63-54882 | | 9/1982 | |
| JP | 60-169608 | U | 11/1985 | |
| JP | 63-48905 | | 4/1988 | |
| JP | 2003-97461 | | 4/2003 | |
| JP | 2003-521613 | | 7/2003 | |
| RU | 2 050 441 | C1 | 12/1995 | |
| RU | 2050441 | C1 * | 12/1995 | 60/645 |
| WO | WO 97/43550 | | 11/1997 | |
| WO | WO 01/55561 | A1 | 8/2001 | |
| WO | WO 2006/097089 | A2 | 9/2006 | |
| WO | WO 2007/104970 | A2 | 9/2007 | |

OTHER PUBLICATIONS

Industrial Waste-Heat Recovery by Cecilia Arzbaecher Dated 2007.*

Examination Report issued in Great Britain Application No. GB0802315.2 dated Mar. 2, 2012 (2 pages).

International Search Report and Written Opinion for corresponding PCT Application No. PCT/GB2009/000334.

Search Report issued in United Kingdom Patent Office dated May 28, 2008 for Appln. No. GB0802315.2 (2 pages).

Article by Ian K. Smith, The Expressor: An Efficiency Boost to Vapour Compression Systems by Power Recovery from the Throttling Process, AES-vol. 34, 1995 (8 pages).

Japanese Examination Report for Application JP 2010-545551 dated Nov. 20, 2012 with English Translation (10 pages).

Mechanical Engineering Handbook, Basics A6, Heat engineering, Japan, The Japan Society of Mechanical Engineers, Dec. 25, 1985, p. 50 (1 page).

* cited by examiner

GENERATING POWER FROM MEDIUM TEMPERATURE HEAT SOURCES

FIELD OF THE INVENTION

This invention relates to the generation of mechanical power from medium temperature heat sources.

BACKGROUND OF THE INVENTION

Mechanical power is commonly recovered from external heat sources, such as combustion products, in a Rankine Cycle system, using steam as the working fluid. However, in recent years, as interest has grown in using heat sources at lower temperatures for power recovery, there has been a growing trend to look for alternative working fluids and for heat sources at temperatures of less than about 200° C. In most cases, it has been shown that organic fluids such as light hydrocarbons or common refrigerants are appropriate. These fluids have unique properties and much of the art of getting the best system for power recovery from a given heat source is based on the choice of the most suitable fluid.

Those fluids most commonly used, or considered, are either common refrigerants, such as R124 (Chlorotetrafluorethane), R134a (Tetrafluoroethane) or R245fa (1,1,1,3,3-Pentafluoropropane), or light hydrocarbons such as isoButane, n-Butane, isoPentane and n-Pentane. Some systems incorporate highly stable thermal fluids, such as the Dowtherms and Therminols, but the very high critical temperatures of these fluids create a number of problems in system design which lead to high cost solutions.

There are, however, numerous sources of heat, mainly in the form of combustion products, already used for other processes, such as the exhaust gases of internal combustion (IC) engines, where the temperatures are rather higher, typically having initial values in the range 200°-700° C., where organic working fluids are associated with thermal stability problems and their thermodynamic properties are less advantageous. Unfortunately, at these temperatures, conventional steam cycles also have serious deficiencies.

Russian patent publication no. RU2050441 discloses a method of producing electrical power by recovering energy from steam that is available as a waste product produced by an industrial process. The dryness fraction of the steam is maintained in the range of 0.6 to 1, hence the steam is relatively dry. The expansion of steam may be carried out in a twin screw machine.

SUMMARY OF THE INVENTION

The present invention is concerned with optimising the power recovery from external heat sources in the temperature range of 200° C.-700° C. The invention is based on the appreciation that the use of wet steam (even steam having a low dryness fraction) can provide higher efficiency power recovery from medium temperature heat sources such as those in the 200° C.-700° C. temperature range than known power generation cycles such as a Rankine cycle operating with water or organic fluids as the working fluid, when the working fluid is condensed at the same, or even a slightly lower temperature.

According to one aspect, the present invention provides a method of generating power from a source of heat at temperatures in the range of 200° to 700° C. comprising the steps of heating water in a boiler with heat from the source to generate wet steam having a dryness fraction of 0.1 to 0.9 (10% to 90%), expanding the wet steam to generate the power in a positive displacement expander, condensing the expanded steam to water at a temperature in the range of 70° C. to 120° C. and returning the condensed water to the boiler.

Such a system is most suitable for obtaining power outputs in the 20-500 kW range, from hot gases such as IC engine exhausts or other hot gas streams in this intermediate temperature range.

According to a further aspect, the present invention provides apparatus for generating mechanical power comprising a source of heat, a steam boiler arranged to receive heat from the source at temperatures in the range of 200° to 700° C., and thereby generate wet steam having a dryness fraction of 0.1 to 0.9 (10% to 90%), a positive displacement expander to expand the steam and thereby generate further mechanical power, a condenser sized to condense the expanded steam to water at a temperature in the range of 70° C. to 120° C. and a feed pump for returning the water to the boiler.

The invention will now be further described by way of example with reference to the drawings in which:—

DETAILED DESCRIPTION

Figure 1A:
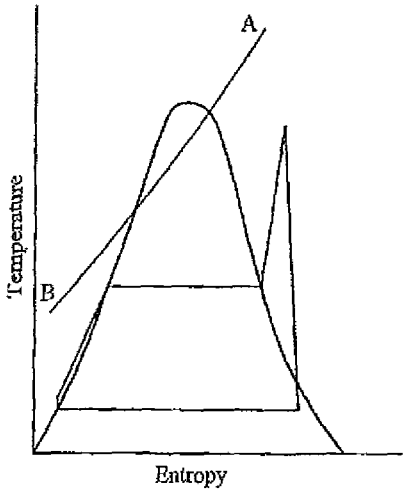
FIGS. 1A and 1B show respectively the cycle (temperature plotted against entropy) and the system components of a Conventional Steam Rankine Cycle.

In the following description, the same reference numerals are used wherever possible to refer to the same components.

Rankine Cycle Systems

Figure 1B:
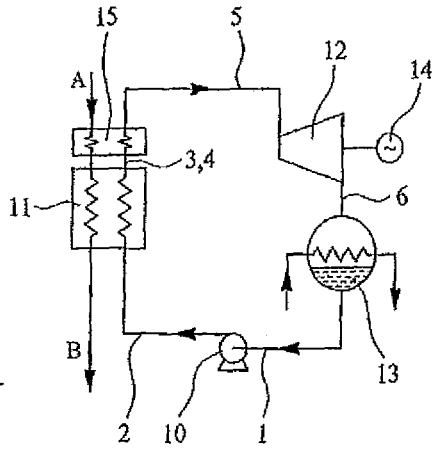

A basic Rankine cycle system, using steam, is shown in FIGS. 1A and 1B. Points 1 to 6 on the Temperature-entropy diagram correspond to points 1 to 6 in the system diagram.

The basic Rankine cycle comprises only four main elements, namely, a feed pump (10), a boiler (11) to heat and vaporise the water, an expander (12) for generating mechanical power, and a condenser (13) coupled to a generator (14) to reject the waste heat and return the water to the feed pump inlet. Hot fluid enters the boiler at A and cooled fluid leaves the boiler at B. Normally, the expander (12) is a turbine, when it is preferable to superheat it in a superheater (15) before expansion begins in order to avoid condensation of vapour during the expansion process. This is important because steam velocities within the turbine are very high and any water droplets, so formed, impinge on the turbine blades and erode them and also reduce the turbine efficiency.

Figure 2:
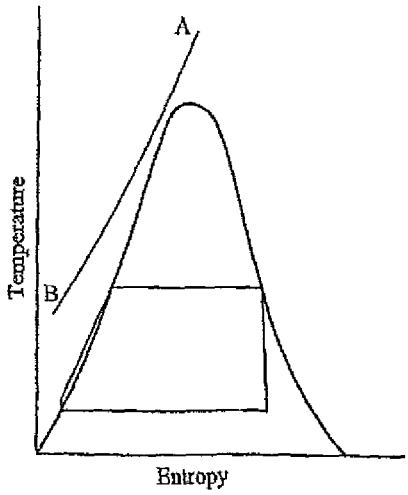
FIG. 2 shows a Saturated Steam Rankine Cycle.

By using special materials on the turbine blade leading edges it is possible to reduce the blade erosion problem and thereby steam can enter the turbine in the dry saturated vapour condition, as is done in some geothermal systems. Such a cycle is shown in FIG. 2, and this allows for increasing wetness in the latter stages of expansion at the sacrifice of some efficiency. However, no turbine has yet been constructed that can safely accept wet fluid at its inlet.

Figure 3:
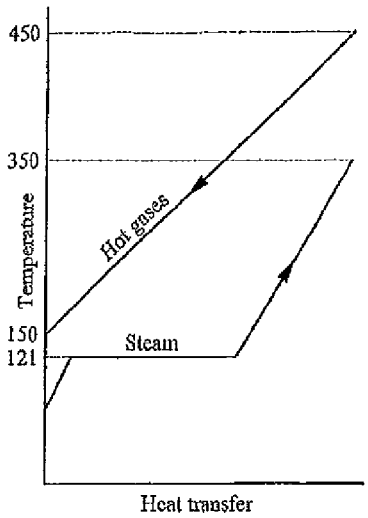
FIG. 3 shows boiler temperature plotted against heat transfer for Superheated steam.

A problem then exists with admitting superheated or even dry saturated steam to the turbine inlet, which becomes more pronounced as the initial temperature of the heat source is reduced. This is the matching of the temperatures of the heat source and the working fluid in the boiler if all the recoverable heat is to be used. This is best understood by reference to FIG. 3, which shows how the temperature of the working fluid and the heating source change within a boiler, when hot gases are cooled from an initial temperature of 450° C. to 150° C. to heat pressurised water, evaporate it and then superheat it.

Figure 4:
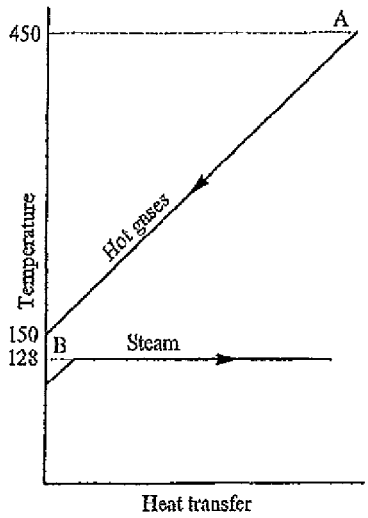
FIG. 4 shows boiler temperature plotted against heat transfer for Saturated steam.

As can be seen, because water has the largest latent heat of any known fluid, the greatest part of the heat received by the steam is required to evaporate it and this occurs at constant temperature. However, the gas stream temperature continuously decreases as it transfers heat to the steam. Accordingly, the evaporating temperature of the steam must be very much lower than that of the initial gas stream temperature and in this case, despite the relatively high initial temperature of the gas stream, the steam cannot evaporate at temperatures much above 120° C. Moreover, if superheat is eliminated, as shown in FIG. 4, the evaporation temperature can only be raised by a few degrees.

This great degradation of temperature needed to evaporate the steam results in a poor power plant cycle efficiency, because high cycle efficiencies are only achieved by increasing the evaporation temperature.

Higher evaporation temperatures are attainable if the exit temperature of the hot gas stream is increased. However raising the gas stream exit temperature reduces the amount of heat recovered. In that case, despite the higher cycle efficiency, the net recoverable power output will be reduced.

Figure 5A:
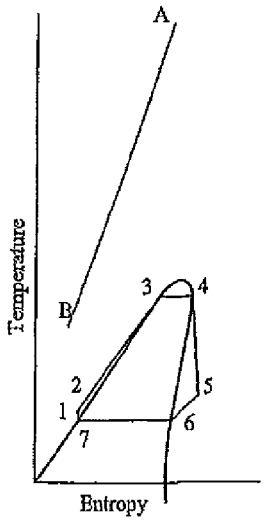
FIGS. 5A and 5B correspond to FIGS. 1A and 1B for a recuperative Organic Rankine Cycle (ORC)
Figure 5B:
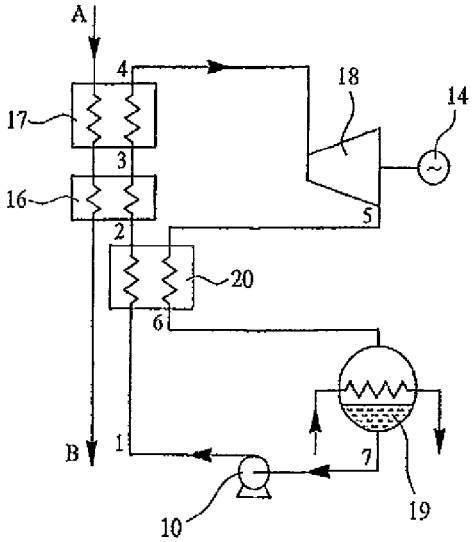

In contrast to this, organic fluids have a much lower ratio of evaporative heating to feed heating and hence can easily attain much higher temperatures, therefore giving better cycle efficiencies. An example of this is shown in FIGS. 5A and 5B where, using the same heat source, it is possible to evaporate pentane at 180° C. This is generally considered to be a safe upper limit for pentane in order to avoid thermal stability problems associated with chemical decomposition of the fluid. The cycle of FIG. 5 includes feed pump (10), boiler or feed heater (16), evaporator (17), expander (18) and desuperheater-condenser (19).

It can be seen in this case that, unlike steam, starting from saturated vapour, the working fluid becomes superheated as it expands. There are therefore no blade erosion problems associated with its use. In order to improve the cycle efficiency at the end of expansion, the low pressure superheated vapour can be passed through a counterflow heat exchanger, or recuperator (20), to recover the heat that would otherwise be rejected in the condenser and use it to preheat the pressurised liquid leaving the feed pump before it enters the boiler (16). Thus, using pentane, higher cycle efficiencies are attainable.

Thermal stability problems are not limited to the bulk temperature of the working fluid, where, in the case of pentane, much higher temperatures are attainable, but with the temperature of the boiler surface in contact with the pentane, which will be far higher, at the hot end. There is also the risk of fire or explosion in the event of any rupture occurring in the heat exchanger wall separating the working fluid from the heating source.

A further problem associated with steam is that it has very low vapour pressures at normal condensing conditions required in vapour power plant rejecting heat either to a cooling water stream or the atmosphere. Thus, at a condensing temperature of 40° C., the vapour pressure of steam is only 0.074 bar. This means that the density of the expanded steam is very low and huge and expensive turbines are required, while there are problems with maintaining a vacuum in the condenser. In contrast to this, pentane at 40° C. has a vapour pressure of 1.15 bar. It is therefore far more dense and consequently, the expander required for it will be much smaller and cheaper.

Screw Expanders

For units of relatively small power output, in the range of 20 kW to 1 MW, it is possible to consider the use of positive displacement machines such as screw expanders, as an alternative to turbines.

As shown for example in EP0898455, a screw expander comprises a pair of meshing helical rotors, contained in a casing which surrounds them. As they rotate, the volume trapped between the rotors and the casing changes. If fluid is admitted into this space at one end of the rotors, its volume will either increase or decrease, depending only on the direction of rotation, until it is finally expelled from the opposite side of the rotors, at the other end.

Power is transferred between the fluid and the rotor shafts by pressure on the rotors, which changes with the fluid volume. Moreover the fluid velocities in such machines are approximately one order of magnitude less than in turbines. Thus, unlike the mode of power transmission in turbomachinery, only a relatively small portion of the power recovered is due to dynamic effects associated with fluid motion. Fluid erosion effects are therefore eliminated and the presence of liquid in the machine, together with the vapour or gas being compressed or expanded, has little effect on its mode of operation or efficiency.

Figure 6A:
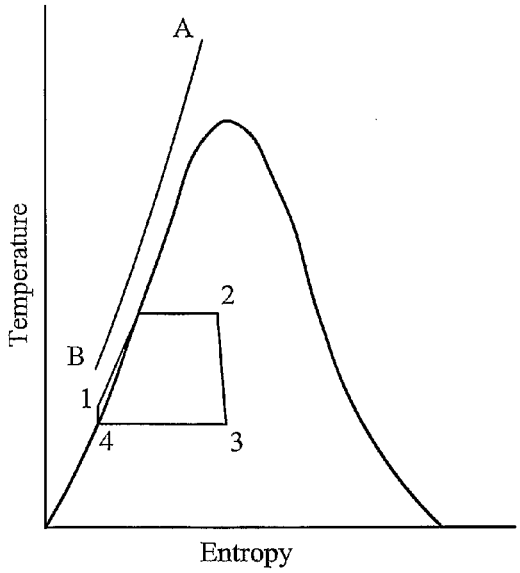
FIGS. 6A and 6B correspond to FIGS. 1A and 1B for a wet steam Rankine cycle.
Figure 6B:
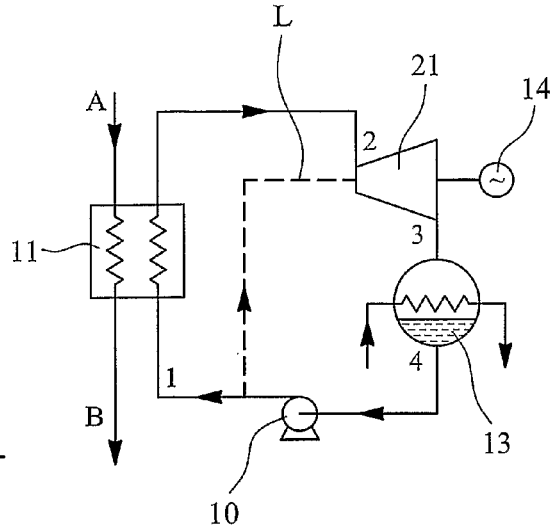

On this basis, steam can be used in a cycle in which it enters as very wet fluid, typically with a dryness fraction of the order of only 0.5, as shown in FIGS. 6A and 6B which includes feed pump (10), boiler (11) a screw expander (21) and a condenser (13). This value can then be adjusted to give the best match between the heat source and the working fluid. Under these operating conditions, it is easy to attain wet steam temperatures of 200 to 240° C. Temperatures much above this value are limited by thermal distortion of the casing and the rotors.

A positive feature of steam is that at these higher temperatures, the pressure is not too high, being only a little over 15 bar at 200° C. and 30 bar at about 240° C.

This and the much higher specific energy of steam than that of organic fluids, implies that the feed pump work required for pressurising the working fluid is much less in a steam cycle than in an organic fluid cycle.

In order to lubricate the bearings of the expander, a line (L) may tap off a small stream of water from the outlet of the pump and supply this water to the bearings. The wet steam itself will tend to lubricate the rotor surfaces and reduce clearance leakages.

The main problem remaining with utilising wet steam with screw expanders therefore lies only with the large size of machine needed to expand to low condensing temperatures.

As will be illustrated by the following two examples, this can be done by raising the condensing temperature of the wet steam, and preferably to approximately 100° C. or more. At this value, this vapour pressure of steam is just over 1 bar and though less than that of the most commonly used refrigerants and hydrocarbon working fluids at the same temperature, is of comparable value.

Some important benefits of raising the condensing temperature of the wet steam, and preferably to approximately 100° C. or more include:

i) the avoidance of problems associated with maintaining a vacuum in the condenser;

ii) the need for a smaller screw expander to be employed with a reduced ratio of expansion; and iii) enabling the condenser to be effectively air cooled in any region of the world compared to power generation systems operating with lower condensing temperatures which require either excessively large and expensive air cooled condensers which absorb too much parasitic power, or water cooling which is rarely practical and available in the locations in which stationary internal combustion engines are commonly installed.

Where cooling water is available or where the ambient temperature is unusually low, the efficiency of the process can be further improved by supplying the rejected heat from it to an Organic Rankine cycle system, as discussed in more detail below.

It is known to use an internal combustion engine driven generator in a Combined Heat and Power (CHP) system in order to maximise the usage of the available energy generated by the internal combustion engine. In such systems, the exhaust gas heat from the IC engine is recovered in a boiler to raise either hot water or steam to be used for heating purposes.

A problem with all CHP systems is that the ratio between power generated and heat recoverable is not always favourable and, in many cases and especially in summer, the heat recovered is simply thrown away because there is no other practical use for it.

The apparatus for generating mechanical power of a preferred embodiment of the present invention rejects heat from the condenser at a temperature of approximately 100-120° C. It is possible to recover this rejected heat which remains at a temperature of around 85-90° C. or approximately 85-90% of the total available energy of the exhaust gases to heat water or steam circulating through in an external hot water system. This provides a CHP system in which 10-15% of the energy of the exhaust gases that is no longer available for heating purposes has been used to produce additional power, thereby offering a more favourable ratio between generated power and heat available for heating.

Figure 7:
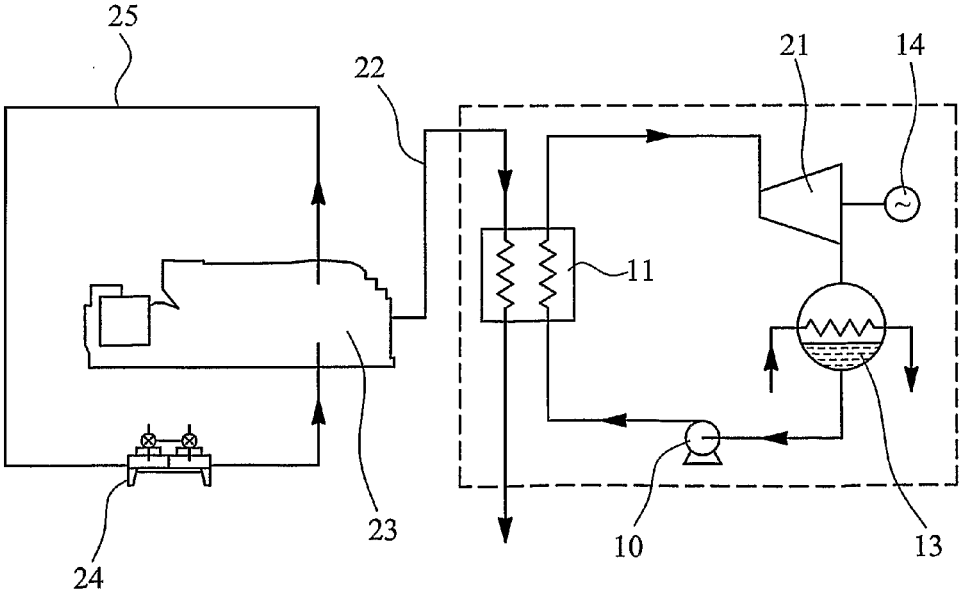
FIG. 7 shows an arrangement for generating power from the heat of exhaust gases of an internal combustion in accordance with FIGS. 6A and 6B.

An arrangement for recovering power from waste heat in the steam of exhaust gases (22) produced by the internal combustion engine (23) of a motor vehicle is shown in FIG. 7. The motor vehicle has radiator (24) and jacket cooling circuit (25). Boiler 11 may be a feed heater-evaporator.

In motor vehicles, the energy released by combustion of the fuel is used in the form of mechanical power developed by the engine, in heat rejected to the exhaust gases and in heat rejected to the cooling jacket, in roughly equal proportions. Cost effective recovery of any of the rejected heat to generate additional power would be highly desirable, especially, in the case of large, long distance transport vehicles, where the annual fuel costs are very large.

A major problem associated with conversion of low grade heat in motor vehicles is to find space for the condenser (13), since the low rejection temperatures required to obtain good cycle efficiencies, require it to be very large. However, if the exhaust gas heat only is used and the condensation temperature is approximately the same as that of the engine jacket coolant, then an air-cooled condenser need be no larger than the engine radiator (24).

Typically, the coolant enters at approximately 90° C. and is returned to the engine jacket at about 70° C. Thus, by condensing at approximately 80° C., it should be possible to fit a waste heat recovery unit into the vehicle.

The following table compares what is possible from a pentane waste heat recovery unit, in which the working fluid enters the expander as dry vapour at 180° C. and the expanded vapour is condensed at 77° C., with the recoverable power from a steam system, where wet steam enters the screw expander at 200° C., with a dryness fraction of 0.45, and is condensed at 100° C. In both cases, it is assumed that the exhaust gases enter the waste heat boiler at 450° C. and leave it at 150° C. and, in the process, 200 kW of heat is transferred from the exhaust gas to the working fluid. All component efficiencies assumed are identical in both cases.

| | Steam | Pentane |
|---|---|---|
| Gross Power Output (kW) | 25.46 | 25.69 |
| Feed Pump Power (kW) | 0.37 | 3.89 |
| Coolant Fan Power (kW) | 0.44 | 0.44 |
| Net Power Output (kW) | 24.65 | 21.36 |
| Relative Feed Heater Surface | 1.31 | 1.36 |
| Relative Evaporator Surface | 0.61 | 0.39 |
| Relative Recuperator Surface | 0 | 3.12 |
| Relative Desuperheater Surface | 0 | 1.27 |
| Relative Condenser Surface | 3.80 | 8.87 |
| Total Relative Surface | 5.72 | 15.01 |
| Expander Volume Flow ($m^3/s$) | 0.128 | 0.056 |

As can be seen from the table, despite the higher condensing temperature of the steam, the steam recovery unit generates 15% more net output and, if, as a good first approximation, it is assumed that the overall heat transfer coefficients in the feed heater, evaporator, recuperator, desuperheater and condenser are all equal, then the steam plant has a total heat exchanger surface only one third of the size of the pentane plant. In fact, due to the superior heat transfer properties of water/steam, this advantage may well be greater. The steam screw expander size would need to be 2.2 times that of the pentane expander but these machines are relatively cheap and the additional cost of this would be far less than the savings made on the steam condenser, apart from the large savings in space.

More significantly than any of the cost and efficiency advantages of the steam unit is that steam is thermally stable and presents no fire hazard, whereas hot pentane, circulating in a motor vehicle, presents a significant risk.

Figure 8A:
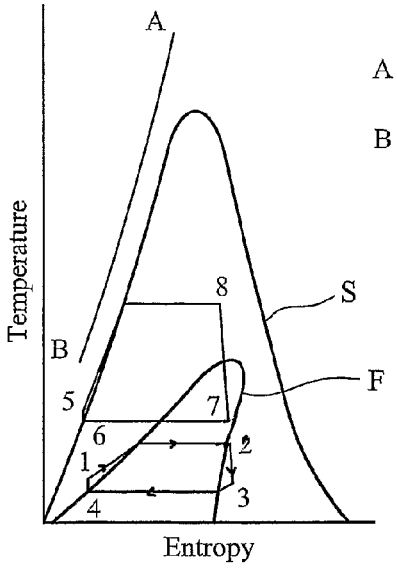
FIGS. 8A and 8B show a combination of a Wet Steam Rankine Cycle and an Organic Rankine Cycle.
Figure 8B:
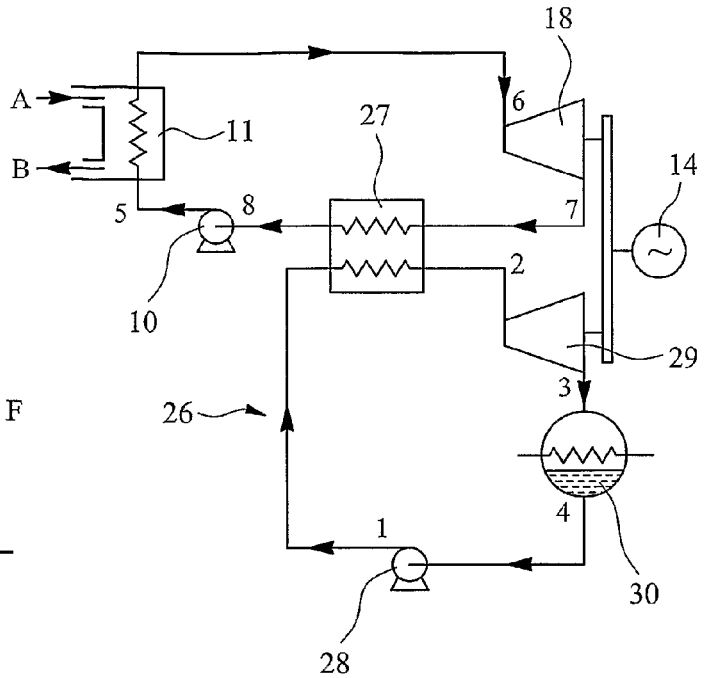

When there is no restriction on the size of the condenser, as in the case of heat recovery from boiler exhaust gases in a stationary plant, much lower condensing temperatures are then possible. Accordingly the heat rejected from the wet steam cycle condenser can be supplied to a low temperature ORC system (26) in order to recover further power, without incurring the problems of large machine sizes required to expand steam to low temperatures. The proposed arrangement for this is shown in FIG. 8A showing steam envelope (S) and organic fluid envelope (F), and corresponding to FIG. 8B which includes water feed pump (10), boiler (11), steam expander (18) and steam condenser-ORC feed heater-evaporator (27), and low temperature ORC system (26) including ORC feed pump (28), ORC expander (29) and desuperheater-condenser (30).

A typical case study was carried out for the recovery of power from a hot gas stream, initially at 412.8° C. (775° F.), cooled down to 200.5° C. (393° F.). The total heat recoverable from this source was 673 kW. Abundant cooling water was available at 10° C. (50° F.).

An established ORC manufacturer proposed to install an exhaust gas heat exchanger to transfer this heat to a water glycol mixture, which would enter the ORC boiler at 130.5° C. (267° F.) and leave it at 79.4° C. (175° F.) as shown in FIG. 10. By this means, it was estimated that 58 kW of power was recoverable. The cycle of FIG. 10 includes internal combustion engine (23), jacket cooling circuit (25) and ORC system (31) including feed heater-evaporator (11), screw expander (21), condenser (13) and feed pump (28), However, with steam condensing at a higher temperature than in known systems, and preferably at approximately 100° C., it is possible to reject the heat from the wet steam cycle and evaporate the vapour in the ORC system (31) shown in FIG. 9 at an even higher temperature. The cycle of FIG. 9 includes exhaust gases (22) passing through exhaust gas heat exchanger (32), coolant circuit (33) and ORC system (31) including feed heater-evaporator (11), expander (29), desuperheater-condenser (30) and feed pump (28). By this means, it was estimated, that after making due allowance for realistically attainable efficiencies of both the wet steam and ORC components and allowing for pressure losses in the pipes, it should be possible to obtain an additional 85 kW of power, bringing the total power output to 142 kW from the combined wet steam ORC system i.e. nearly 2.5 times as much. The overall thermal efficiency of the combined cycle would then be approximately 21%.

A further feature of this combined cycle is that its cost per unit output, would be approximately 20% less than that of the ORC system, together with the exhaust gas heat exchanger. This is because the additional expanders and feed pump are relatively inexpensive, the ORC condenser of the combined system will be smaller because it has to reject less heat than if the entire exhaust gas heat is supplied to the ORC system alone and the intermediate heat exchanger that transfers the heat from the condensing steam to the organic working fluid will be very compact due to the exceptionally high heat transfer coefficients of both the condensing steam and the evaporating organic vapour.

Stationary gas engines are widely used today to generate power, especially from landfill gas. To maximize their efficiency power can be recovered from the heat rejected both by the exhaust gases and the jacket coolant. A study of what is possible in such a case was made for a typical gas engine. This was a GE Jenbacher J320GS-L.L. This engine has a rated electrical power output of 1065 kW. The recoverable heat from the exhaust gases in cooling from 450° C. to 150° C. is 543 kW, while the heat that has to be rejected from the coolant to the surroundings is 604 kW to return it at 70° C., after leaving the jacket at 90° C. Using an Organic Rankine Cycle (ORC) system for the conversion of the heat to power, there are two simple arrangements possible. The first is to use separate units for recovery of heat from the coolant and the exhaust gases as shown in FIGS. 10 and 11, respectively.

Figure 11:
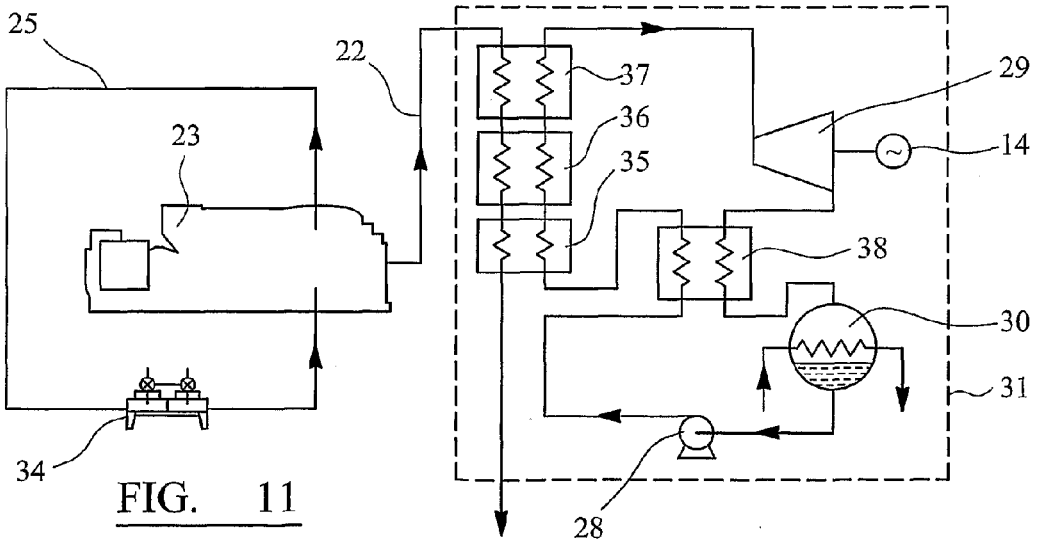
FIG. 11 is a diagram similar to FIG. 7 of a Superheated Organic Rankine Cycle (ORC)

The cycle of FIG. 11 includes internal combustion engine (23), jacket coolant circuit (25), coolant heat exchanger (34), exhaust gases (22) and ORC system (31) including feed heater (35), evaporator (36), superheater (37), expander (29), desuperheater-condenser (30), recuperator (38) and feed pump (28). The recuperative superheat cycle is shown to maximise the cycle efficiency.

Figure 12:
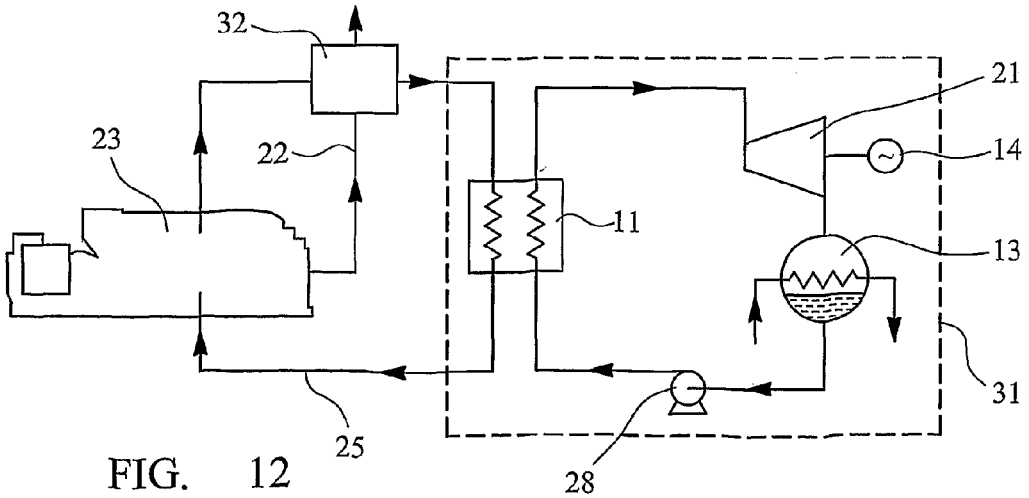
FIG. 12 shows an arrangement for generating power from both exhaust gases and cooling jacket of an IC engine using a Vapour Organic Rankine Cycle (ORC)

The second possibility is to recover the heat from the exhaust gases by transferring it to the jacket coolant and then transferring the entire recovered waste heat to a simple ORC system, as shown in FIG. 12. The cycle of FIG. 12 includes internal combustion engine (23), jacket coolant circuit (25), exhaust gases (22), exhaust gas heat exchanger (32) and ORC system (31) including feed heater-evaporator (11), screw expander (21), condenser (13) and feed pump (28).

Figure 13A:
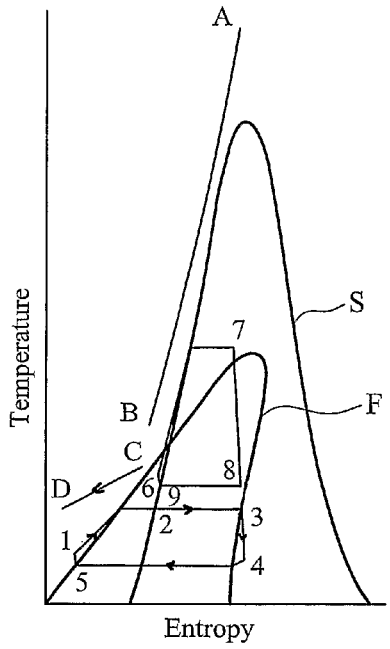
FIGS. 13A and 13B show alternative operating cycles for a combined steam and ORC System for generating power from two heat sources at different temperatures.
Figure 13B:
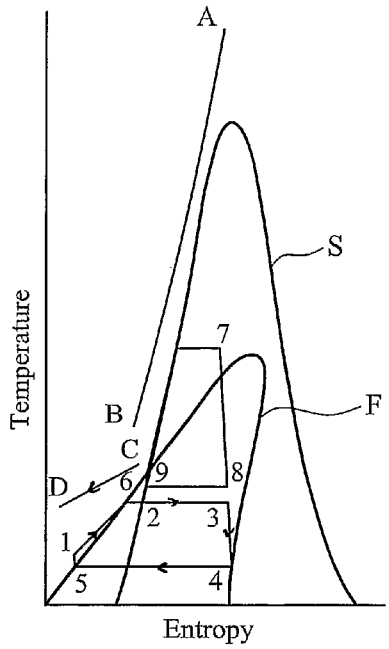
Figure 13C:
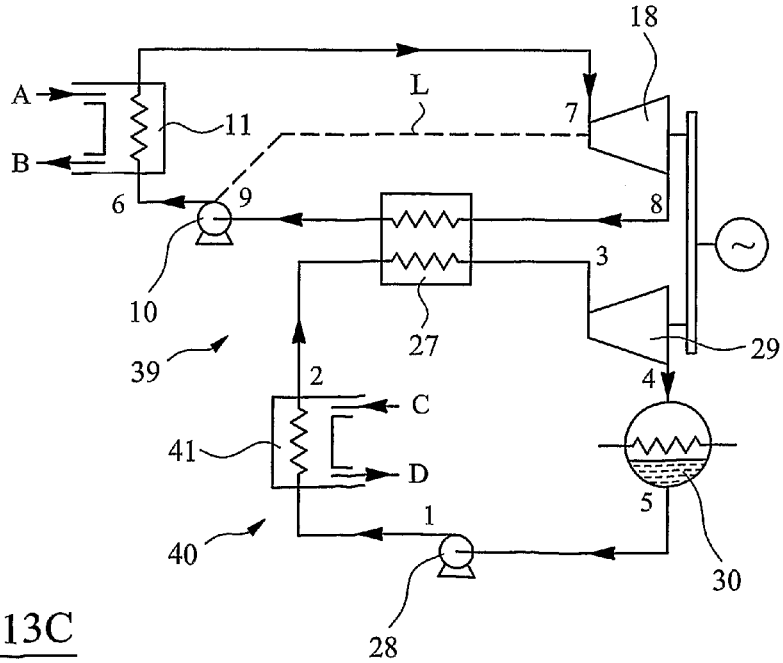
FIG. 13C shows an arrangement for generating power from exhaust gases using a steam cycle and supplying rejected heat to an ORC system which also receives heat from the cooling jacket of an IC engine.

A further possibility is to use a wet steam system (39) to recover the exhaust gas heat, condensing at approximately 100° C. and supplying the rejected heat to a lower temperature ORC system (40), which also receives the jacket heat, as shown in FIG. 13C. The wet steam system includes boiler (11), steam expander (18), steam condenser-ORC evaporator (27), feed pump (10) and line (L). The ORC system includes steam condenser-ORC evaporator (27), ORC expander (29), desuperheater-condenser (30), feed pump (28) and feed heater evaporator (41).

In this case, there are two similar organic cycles. In FIG. 13A, the vapour admitted to the expander is dry, hence the expanded vapour has to be desuperheated before it begins to condense.

In the cycle shown in FIG. 13B, the vapour admitted to the expander is slightly wet. This is only possible with a screw expander (or for smaller powers scroll type expander) and eliminates the need for desuperheat, thereby raising the ORC efficiency.

All these cases were analysed, assuming that the heat is finally rejected from the waste heat power recovery system to the surrounding atmospheric air is at a temperature corresponding to annual average ambient conditions in the UK.

In all four cases, the organic working fluid was taken to be R245fa. This was selected in preference to n-Pentane because it is a better fluid for low condensing temperatures, where it leads to cheaper and more compact expanders and condensers as well as a better bottoming cycle efficiency.

The results of the study are contained in the following table.

Figure 9:
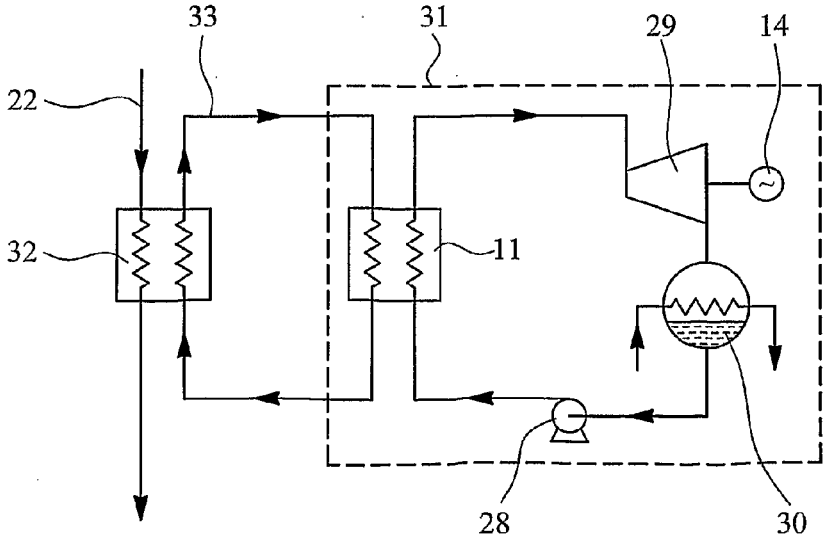
FIG. 9 shows an arrangement for generating power from exhaust gases using an Organic Rankine Cycle.
Figure 10:
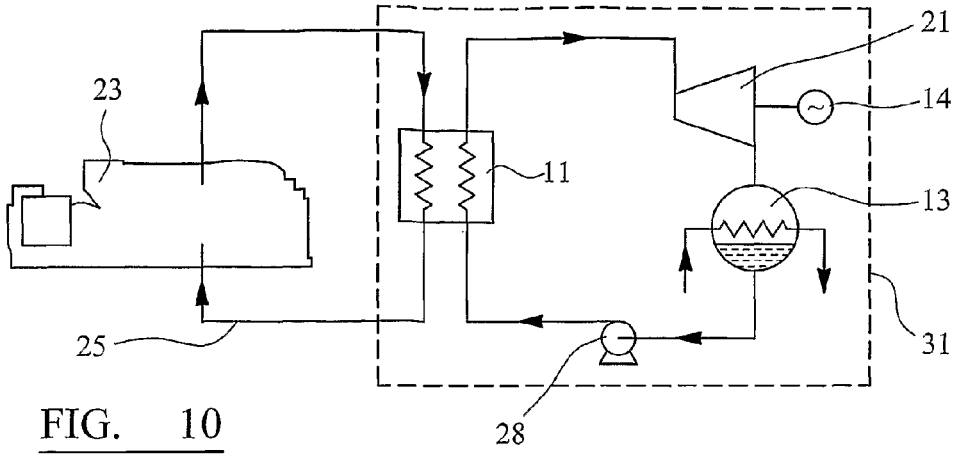
FIG. 10 shows an arrangement for generating power from the heat of a cooling jacket of an internal combustion engine by means of a Vapour Organic Rankine Cycle (ORC)

| | Total Net Power Output (kW) |
|---|---|
| Single ORC Unit as in FIG. 12 | 81 |
| Two Separate Simple ORC Units as in FIGS. 9 and 10 | 96 |
| Two Separate ORC Units with Superheat and Recuperation as in FIGS. 9 and 11 | 106 |
| Wet Steam Cycle System Coupled to Low Temperature Simple ORC System as In FIG. 13C | 140 |

The superiority of the steam-organic combination is both obvious and overwhelming and its use could lead to a 32% boost in the total power output of the system.

Screw Expander Arrangements

As already stated, screw expanders rotate with much lower tip speeds than turbines. Accordingly, it is possible to design them to be directly coupled to a 50/60 Hz generator without the need for an intermediate gearbox, as shown in FIG. 13. However, since most of the applications of concern for this invention, are for relatively small power outputs, they can be coupled to a generator, by a simple belt drive to allow for more flexibility in selecting the expander operating speed by appropriately sizing the belt pulleys.

In the case of their being used to boost the power and efficiency of an IC engine, then a further possibility is to eliminate the need for a generator and couple the screw expander to the main drive shaft of the IC engine.

Screw expanders have a more limited range of operation than turbines, if they are to be efficient and for best results, the pressure ratio of expansion should not much exceed 4:1. In the case of this invention, where pressure ratios of the order of 15:1 are required for the steam expansion, a two stage configuration, comprising two expanders in series, is therefore required. Again, the two stages can be coupled either to the main IC engine, where appropriate or to a generator.

Figure 14A:
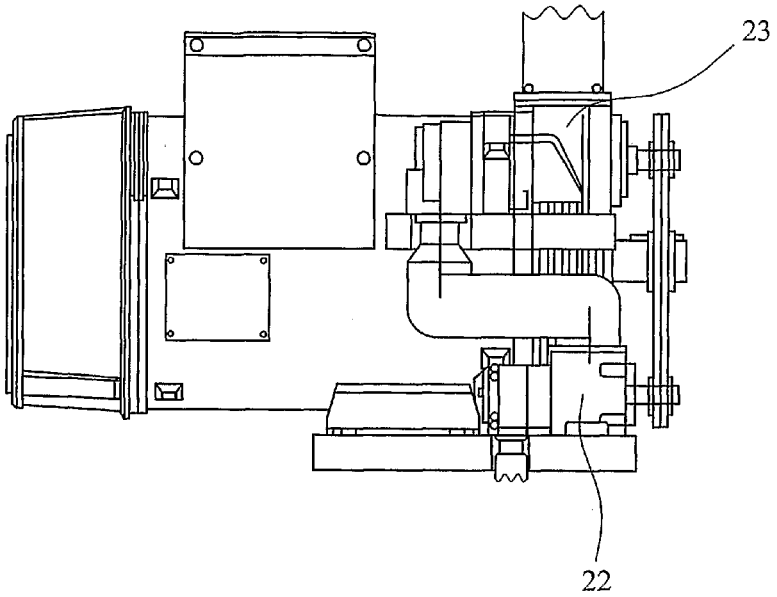
FIGS. 14A and 14B are side and end elevational views of expanders such as are employed in the system of FIG. 13C.
Figure 14B:
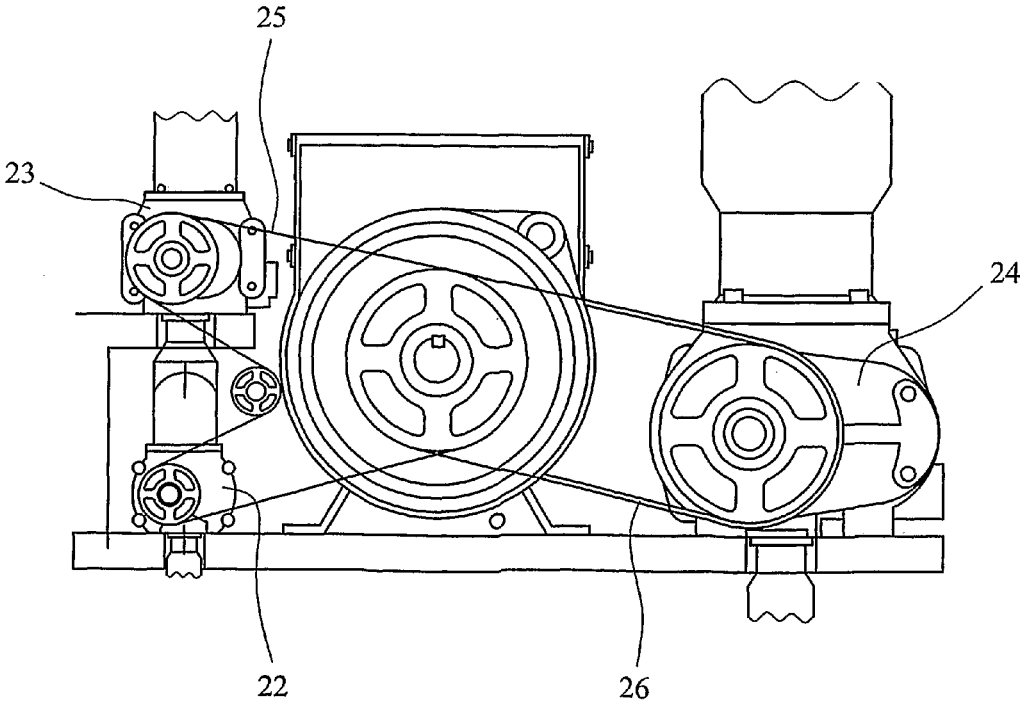

In the case of a wet steam topping cycle, linked to an ORC bottoming cycle, in which both units use screw expanders, all three units can be linked to a common drive, as shown in FIGS. 14A and 14B where a high pressure twin screw steam expander 22 feeding a low pressure steam expander 23 and an ORC expander 24 all have their power shafts connected by belts 25, 26 and pulleys.

The invention claimed is:

1. A method of generating power from a source of heat at temperatures in the range of 200° to 700° C. by performing the following steps sequentially in a continuous cycle:

(a) heating water in a boiler with heat from the source to generate wet steam having a dryness fraction of 0.1 to 0.9 (10% to 90%);

(b) passing the wet steam from the boiler directly to a positive displacement steam expander;

(c) expanding the wet steam received directly from the boiler to generate the power in the positive displacement steam expander;

(d) condensing the expanded steam to water at a temperature in the range of 70° C. to 120° C.;

(e) returning the condensed water to the boiler; and (f) repeating steps (a)-(e) in a continuous cycle.

2. A method according to claim 1 wherein the pressure of the wet steam does not exceed 30 bar.

3. A method according to claim 1 wherein the steam expander is a twin-screw or scroll expander.

4. A method according to claim 3 wherein expanding is effected in at least two stages.

5. A method according to claim 1 wherein the expanded steam is condensed by heat exchange with a pressurised organic fluid operating in an organic Rankine cycle.

6. A method according to claim 1 wherein the expanded steam is condensed by heat exchange with a fluid operating in a heating system thereby providing a Combined Heat and Power System.

7. A method according to claim 1 wherein the source of heat is a stream of exhaust gases from an engine.

8. A method according to claim 7 wherein heat from a cooling jacket of the engine is added to the heat from condensing the expanded steam.

9. A method according to claim 7 wherein the engine is an internal combustion engine or a gas turbine engine.

10. A method of generating power from a source of heat at temperatures in the range of 200° to 700° C. comprising the steps of:

heating water in a boiler with heat from the source to generate wet steam having a dryness fraction of 0.1 to 0.9 (10% to 90%);

expanding the wet steam to generate the power in a positive displacement steam expander;

condensing the expanded steam to water at a temperature in the range of 70° C. to 120° C.; and returning the condensed water to the boiler.

* * * * *